United States Patent [19]

Zerillo

[11] Patent Number: 5,036,214

[45] Date of Patent: Jul. 30, 1991

[54] REMOTE CONTROL SWITCH FOR CONTROLLING TWO ELECTRIC SUPPLIES

[76] Inventor: Michael A. Zerillo, 4143 Elizabeth La., Annandale, Va. 22003

[21] Appl. No.: 531,340

[22] Filed: May 31, 1990

Related U.S. Application Data

[62] Division of Ser. No. 413,283, Sep. 27, 1989, Pat. No. 4,958,112.

[51] Int. Cl.[5] ..... H01H 3/28; H01H 9/54

[52] U.S. Cl. ..... 307/140; 307/143; 307/23

[58] Field of Search ..... 307/18, 19, 23, 25, 307/29, 64, 71, 80, 85, 125, 139, 140, 141, 143, 592; 318/16, 480

[56] References Cited

U.S. PATENT DOCUMENTS

| | | | |
|---|---|---|---|
| 3,514,626 | 5/1970 | Platzer, Jr. | 307/140 X |
| 3,792,289 | 2/1974 | Kazem | 307/125 |
| 3,808,456 | 4/1974 | Kay et al. | 307/140 |
| 4,578,593 | 3/1986 | Davidov | 307/140 X |
| 4,610,294 | 9/1986 | Anesi et al. | 307/141 X |
| 4,668,878 | 5/1987 | Wyss | 307/139 X |
| 4,755,691 | 7/1988 | Bethea | 307/140 X |
| 4,912,376 | 3/1990 | Strick | 307/139 X |

*Primary Examiner*—Bentsu Ro

[57] ABSTRACT

A remote control mechanism for controlling electricity from a non-interruptible electric supply, and for optionally and simultaneously controlling electricity from a second, but interruptible electric supply like that provided by a clock-actuated switch in series with a continuous electric supply. The mechanism is useful as an actuating means for electrical apparatus plugged-in to its outlet.

8 Claims, 2 Drawing Sheets

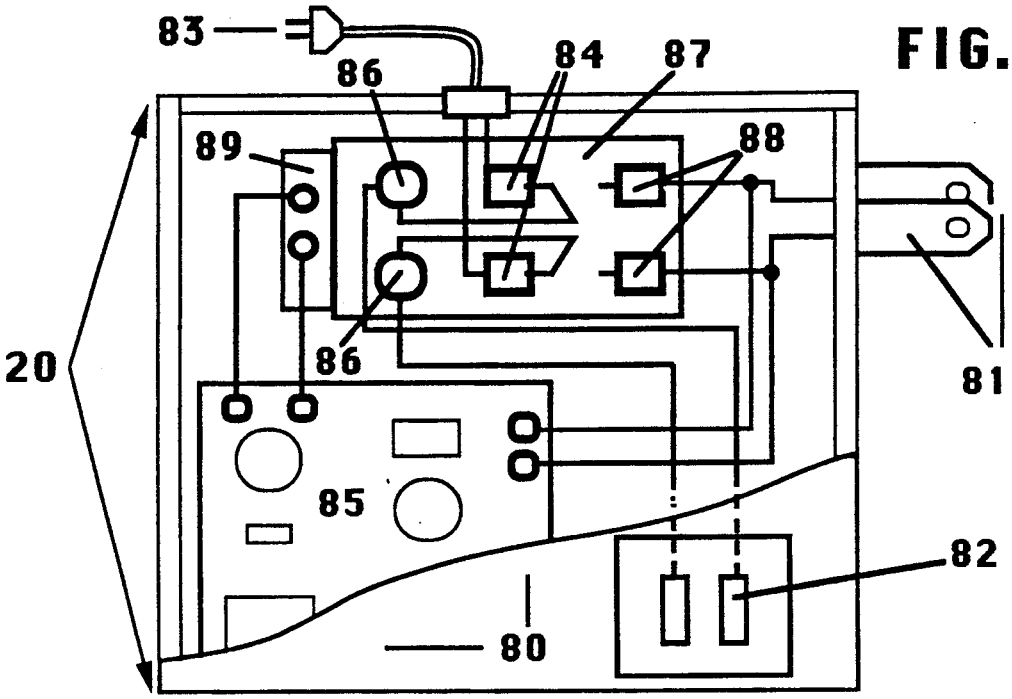
FIG. 3
FIG. 4
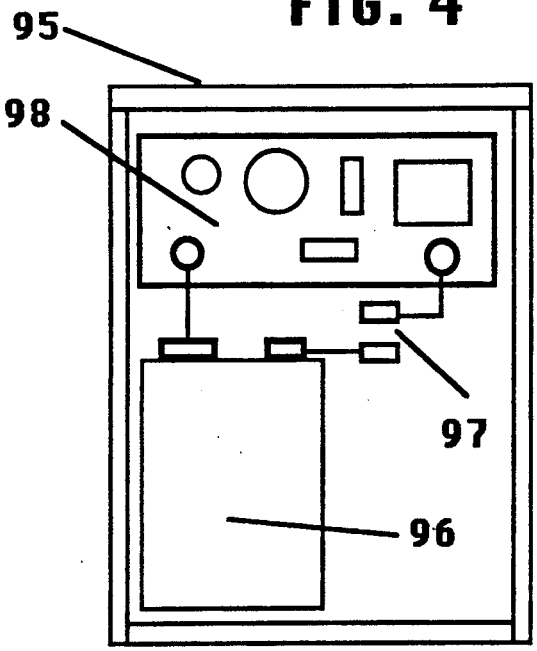

REMOTE CONTROL SWITCH FOR CONTROLLING TWO ELECTRIC SUPPLIES

This is a divisional application of Ser. No. 07/413,283, filed Sept. 27, 1989, now U.S. Pat. No. 4,958,112.

BACKGROUND

Remote control switches are well known in the art. One such device is Tandy Corporation's Radio Shack Wireless Remote Switch (Catalog No. 61-2667). It connects to a single electric supply, and comprises a receiver-controlled switch and a hand-held transmitter for switching electricity ON and OFF. A lamp or appliance plugged-in to its outlet may be switched ON and OFF from a remote location.

A new device, revealed as an actuating means for the drapery actuator described in the aforesaid Patent, is a remote control apparatus that can control electricity from a single electric supply, and optionally and simultaneously control electricity from a second electric supply. This invention safely controls electricity from both electric supplies by means of a single switch and a single outlet. An electrical device plugged-in to its outlet may be caused to switch ON and OFF.

SUMMARY OF THE INVENTION

A principal object of the present invention is to provide a mechanism that controls electricity from a single electric supply, and optionally and simultaneously controls electricity from a second electric supply.

An additional object of the present invention is to provide a mechanism comprising a first plug for connecting to a non-interruptible electric supply as an ordinary electric wall outlet, and a second plug for connecting to an interruptible electric supply such as a timer-controlled switch like Intermatics Corporation's Time-All Model SB711.

An additional object of the present invention is to provide a mechanism comprising a receiver-controlled switch for controlling electricity to an outlet of the invention.

An additional object of the present invention is to provide a mechanism comprising a hand-held wireless transmitter for controlling the receiver-controlled switch of the invention from a remote location.

DESCRIPTION OF DRAWINGS

FIG. 3 illustrates the switch and circuit means of the present invention, its two plugs, its outlet, and its radio frequency receiver.

FIG. 4 illustrates the wireless hand-held transmitter of the present invention.

DESCRIPTION OF THE PREFERRED EMBODIMENT

Figure 1:
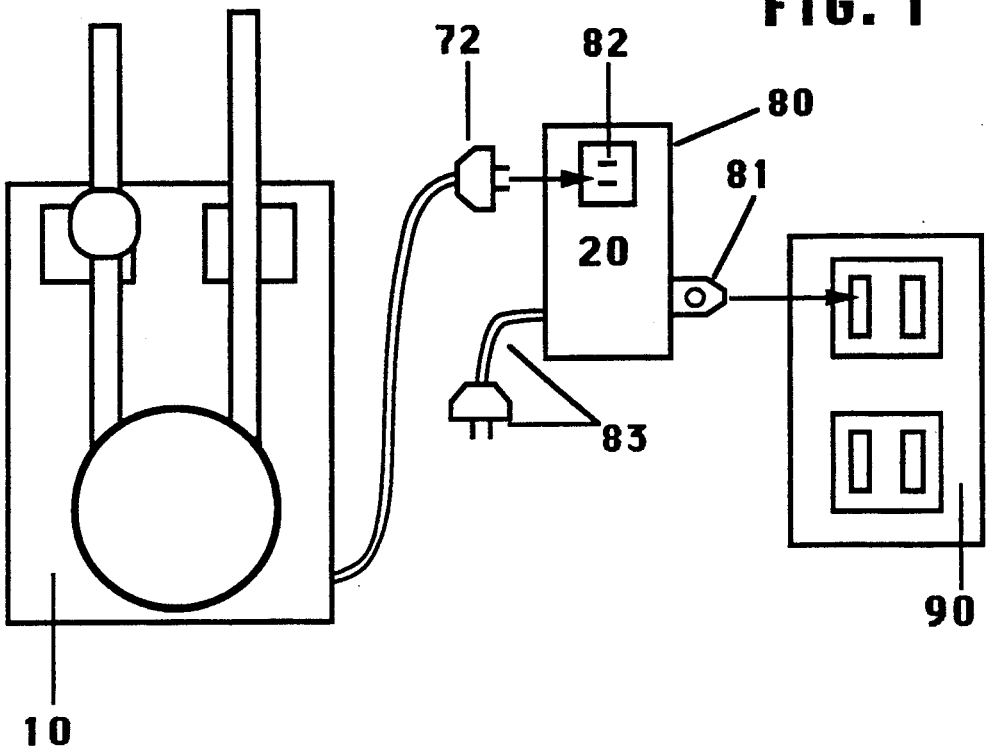
FIG. 1 illustrates the first plug of the present invention connected to an ordinary electric wall outlet, its second plug not utilized, and the drapery actuator of U.S. Pat No. 4,958,112 plugged-in to the outlet of the present invention.

In the context of this Preferred Embodiment, electrical device 10 is a generic electrical apparatus. Electrical device 10 is representational of the drapery actuator of U.S. Pat No. 4,958,112, but may alternately represent a lamp, an appliance, or other electrical apparatus.

A mechanism 20 is provided as a means for switching electricity ON and OFF to electrical device 10. Mechanism 20 comprises main housing 80, plug 81, plug 83, outlet 82, radio frequency receiver 85, receiver-controlled switch 87, and hand-held transmitter 95.

Not provided with mechanism 20 is timer-controlled switch 100, similar to the Intermatics Corporation's Time-All Model SB711. This device comprises a 24-hour clock mechanism with adjustable acutators controlling a switch that causes electricity to be switched ON and OFF to its receptacle 101. Such switches are common in many households and are used to turn lamps ON and OFF at desired times of the day.

Mechanism 20 is unique in that it can be connected with one or two electric supplies. Mechanism 20 is useful as an actuator for switching electrical device 10 ON and OFF, and can be used in two operating configurations. For reference, these configurations are named: (a) remote control, and, configuration (b) remote and timer-actuated control. The following are examples of the set-up procedure and operating features of each configuration.

To set-up mechanism 20 in configuration (a) remote control, plug 81 is plugged into an ordinary electric wall outlet 90 as illustrated in FIG. 1. Electrical device 10 is then plugged-in to outlet 82. Mechanism 20 is now ready to operate electrical device 10. As illustrated in FIG. 3, switch 87 is a double-pole, double-throw latching relay switch having actuation coil 89. Poles 86 are wired directly to outlet 82. The conductors of plug 81 are wired to radio frequency receiver 85 and to normally open terminals 88. When plug 81 is plugged-in to outlet 90, electricity is available to receiver 85 to provide continuous power for its operation, and continuously provides electricity to terminals 88. The conductors of plug 83 are wired to the normally closed terminals 84. In configuration (a), plug 83 is not connected to an electric supply, thereby electricity is not available to terminals 84. In configuration (a), when switch 87 is in its normally closed position, its switch contacts are engaged with terminals 84, therefore electricity is not available to poles 86 or to outlet 82. However, when hand-held transmitter 95 is actuated, receiver 85 actuates coil 89. Thereby the switch contacts of switch 87 are actuated causing them to engage terminals 88 and latch in that position. Electricity available at terminals 88 is thereby provided to poles 86, and then to outlet 82. Electrical device 10 is switched ON in this manner. Subsequently, when transmitter 95 is again actuated, receiver 85 actuates coil 89 again. This causes the switch contacts of switch 87 to unlatch and return to normally closed terminals 84. Electricity is switched OFF to outlet 82, and electrical device 10 is switched OFF. Thereby, when electrical device 10 is plugged-in to outlet 82, and when mechanism 20 is set-up in configuration (a), electrical device 10 may be switched ON and OFF by remote control operation of mechanism 20.

Figure 2:
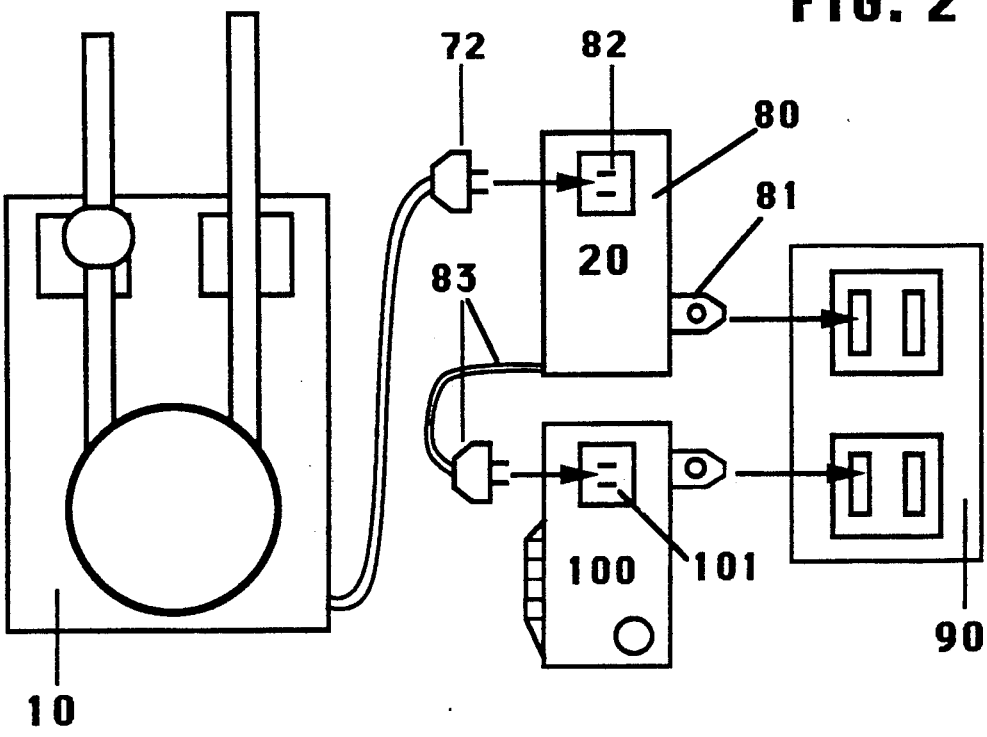
FIG. 2 illustrates the first plug of the present invention connected to an ordinary electric wall outlet, its second plug connected to the outlet of a timer-controlled switch, the timer-controlled switch connected with an ordinary electric wall outlet, and the drapery actuator of U.S. Pat. No. 4,958,112 plugged-in to the outlet of the present invention.

To set-up mechanism 20 in configuration (b) remote and timer-actuated control, plug 81 is plugged into one of the two receptacles of an ordinary electric wall outlet 90 as illustrated in FIG. 2. Plug 83 is plugged-in to outlet 101 of timer-controlled switch 100. The timer-controlled switch 100 is manually set to OFF, and it is plugged-in to the other receptacle of outlet 90. Each receptacle of outlet 90 provides electricity, and thereby mechanism 20 is said to be connected with two (2) electric supplies. However, two (2) separate wall outlets (not demonstrated) could be used instead and mechanism 20 would operate in the same manner as will be described. Mechanism 20 is now ready to operate the electrical device 10 in configuration (b). When the timer-controlled switch 100 is OFF, and when switch 87 is in its normally closed position, electricity is not available to terminals 84 and thereby not available to outlet 82. But if the timer-controlled switch 100 is actuated ON, electricity is provided to outlet 101, and then to terminals 84 by means of plug 83. If the switch contacts of switch 87 are in their normally closed position, electricity is provided to poles 86 and to outlet 82. Electrical device 10 plugged-in to outlet 82 is switched ON in this way. Subsequently, if the timer-controlled switch 100 is actuated OFF, electricity is terminated to outlet 101, terminals 84, poles 86, and outlet 82; and thereby electrical device 10 is switched OFF. Electrical device 10 is thereby switched ON and OFF by the operation of timer-controlled switch 100 whenever the switch contacts of switch 87 are located in their normally closed position. In configuration (b), electricity may also be switched ON and OFF to outlet 82 by means of transmitter 95 in the same way as described for configuration (a). Thereby, when electrical device 10 is plugged-in to outlet 82, and when mechanism 20 is set-up in configuration (b), electrical device 10 may be switched ON and OFF by remote control operation of mechansim 20 and by timer-controlled switch 100.

The hand-held transmitter 95 complies with UNITED STATES FCC Rules Part 15. As illustrated in FIG. 4, transmitter 95 has circuit means and battery 96, normally-open switch 97, and a signal transmitter 98 already known in the art, and used for transmitting a signal over a predetermined distance. As illustrated in FIG. 3, housing 80 comprises radio frequency receiver 85 that has the means to respond to signals from transmitter 95, and thereby is useful for actuating coil 89 and the switch contacts of switch 87 as previously described. It is noteworthy that an infrared transmitter and receiver (also know in the art), has been successfully substituted for radio frequency receiver 85 and signal transmitter 98 in test models of mechanism 20; thereby, this and other types of remote control systems are useful as components of mechanism 20.

The disclosure of the invention described herein represents the preferred embodiment of a mechanism useful for control of a single electric supply, and useful to optionally and simultaneously control a second electric supply. It should be apparent to those skilled in the art that the invention permits of variations therefrom in its form, construction, arrangement, application, and detail; in whole and in part. I claim as my invention all such variations within the spirit and scope of the following claims.

I claim:

1. A mechanism for controlling electricity from a first electric supply and for optionally and simultaneously controlling electricity from a second electric supply, wherein said mechanism comprises receiver-controlled switch means and circuit means for providing and terminating said electricity to outlet means of said mechanism, said mechanism is useful as an actuation means of electrical apparatus plugged-in to said outlet means, said mechanism further comprising:

first conductor means having first plug means for connecting said receiver-controlled switch means to said first electric supply whereas said first electric supply is a non-interruptible electric supply;

second conductor means having second plug means for optionally and simultaneously connecting said receiver-controlled switch means to said second electric supply whereas said electric supply is an interruptible electric supply;

signal transmitter means whereas said receiver-controlled switch means is responsive to signals from said signal transmitter means;

said signal transmitter means is remotely locatable and comprises actuating means for causing said signals to be transmitted over a predetermined distance.

2. The mechanism of claim 1, wherein said first plug means is connected with said first electric supply and wherein said second plug means is not connected with any electric supply;

said electricity is provided to said outlet means when said signal transmitter means is actuated for causing said receiver-controlled switch means to be actuated, wherein said receiver-controlled switch means is not actuated thereby said electricity is not provided to said outlet means.

3. The mechanism of claim 1, wherein said first plug means is connected with said first electric supply and wherein said second plug means is connected with said second electric supply;

said electricity is provided to said outlet means when said signal transmitter means is actuated for causing said receiver-controlled switch means to be actuated;

said electricity is provided to said outlet means when said receiver-controlled switch means is not actuated and when said second electric supply is providing said electricity; when said receiver-controlled switch means is not actuated and when said second electric supply is not providing said electricity thereby said electricity is not provided to said outlet means.

4. The mechanism of claim 1, wherein said first conductor means is connected to normally-open switch contact means of said receiver-controlled switch means, wherein said second conductor means is connected to normally-closed switch contact means of said receiver-controlled switch means, wherein pole means of said receiver-controlled switch means are wired to said outlet means.

5. A mechanism for controlling electricity from a first electric supply and for optionally and simultaneously controlling electricity from a second electric supply, wherein said mechanism comprises receiver-controlled switch means and circuit means for providing and terminating said electricity to outlet means of said mechanism, said mechanism is useful as an actuation means of electrical apparatus plugged-in to said outlet means, said mechanism further comprising:

first conductor means having first plug means for connecting said receiver-controlled switch means to said first electric supply whereas said first electric supply is a non-interruptible electric supply;

second conductor means having second plug means for optionally and simultaneously connecting said receiver-controlled switch means to said second electric supply whereas said second electric supply is a clock-actuated switch means, said clock-actuated switch means comprises outlet means and timer-controlled switch means, said timer-controlled switch means switches electricity ON and OFF to the outlet means of said clock-actuated switch means, said clock-actuated switch means is connected with an electric supply;

signal transmitter means whereas said receiver-controlled switch means is responsive to signals from said signal transmitter means;

said signal transmitter means is remotely locatable and comprises actuating means for causing said signals to be transmitted over a predetermined distance.

6. The mechanism of claim 5, wherein said first plug means is connected with said first electric supply and wherein said second plug means is not connected with an electric supply;

said electricity is provided to said outlet means of said mechanism when said signal transmitter means is acutated for causing said receiver-controlled switch means to be actuated, wherein said receiver-controlled switch means is not actuated thereby said electricity is not provided to said outlet means.

7. The mechanism of claim 5, wherein said first plug means is connected with said first electric supply and wherein said second plug means is connected with the outlet means of said clock-actuated switch means;

said electricity is provided to the outlet means of said mechanism when said signal transmitter means is actuated for causing said receiver-controlled switch means to be actuated, when said receiver-controlled switch means is not actuated and when said clock-actuated switch means is switched OFF thereby said electricity is not provided to the outlet means of said mechanism;

said electricity is provided to the outlet means of said mechanism when said receiver-controlled switch means is not actuated and when said clock-actuated switch means is providing said electricity.

8. The mechanism of claim 5, wherein said first conductor means is connected to normally-open switch contact means of said receiver-controlled switch means, wherein said second conductor means is connected to normally-closed switch contact means of said receiver-controlled switch means, wherein pole means of said receiver-controlled switch means are wired to said outlet means of said mechanism.

* * * * *